US009318854B2

(12) United States Patent
Chang

(10) Patent No.: US 9,318,854 B2
(45) Date of Patent: Apr. 19, 2016

(54) DETECTING STRUCTURE OF RECEPTACLE CONNECTOR

(71) Applicant: T-CONN PRECISION CORPORATION, New Taipei (TW)

(72) Inventor: Jen-Hao Chang, Taipei (TW)

(73) Assignee: T-Conn Precision Corporation, Taipei (TW)

( * ) Notice: Subject to any disclaimer, the term of this patent is extended or adjusted under 35 U.S.C. 154(b) by 0 days.

(21) Appl. No.: 14/475,573

(22) Filed: Sep. 3, 2014

(65) Prior Publication Data

US 2016/0006188 A1 Jan. 7, 2016

(30) Foreign Application Priority Data

Jul. 3, 2014 (TW) ..... 103211805 U

(51) Int. Cl.

| | |
|---|---|
| ***H01R 13/46*** | (2006.01) |
| ***H01R 13/516*** | (2006.01) |
| ***H01R 13/703*** | (2006.01) |
| ***H01R 29/00*** | (2006.01) |
| ***H01R 24/00*** | (2011.01) |
| ***H01R 13/6581*** | (2011.01) |

(52) U.S. Cl.

CPC ..... *H01R 13/703* (2013.01); *H01R 13/6581* (2013.01)

(58) Field of Classification Search

CPC .. H01R 2103/00; H01R 13/703; H01R 24/46; H01R 13/6581; H01R 24/62; H01R 29/00; H01R 13/46; H01R 13/516; H01R 24/00

USPC ..... 439/188, 660

See application file for complete search history.

(56) References Cited

U.S. PATENT DOCUMENTS

| | | | | |
|---|---|---|---|---|
| 7,416,428 | B1 * | 8/2008 | Hung | H01R 12/57 439/188 |
| 8,257,100 | B2 * | 9/2012 | Lu | H01R 12/7094 439/188 |
| 8,317,528 | B2 * | 11/2012 | Chen et al. | 439/188 |
| 8,690,608 | B2 * | 4/2014 | Naito | H01R 13/7039 439/607.01 |
| 2007/0015413 | A1 * | 1/2007 | Morohoshi | H01R 12/716 439/676 |
| 2009/0061671 | A1 * | 3/2009 | Qin | H01R 12/712 439/188 |
| 2011/0028024 | A1 * | 2/2011 | Lu | H01R 4/2433 439/395 |
| 2011/0135254 | A1 * | 6/2011 | Hsiao | G02B 6/3845 385/75 |
| 2011/0281449 | A1 * | 11/2011 | Ko | H01R 24/62 439/188 |
| 2012/0015554 | A1 * | 1/2012 | Tseng | 439/607.01 |
| 2013/0210251 | A1 * | 8/2013 | Little et al. | 439/188 |
| 2013/0316592 | A1 * | 11/2013 | Yu | H01R 13/516 439/660 |
| 2014/0051274 | A1 * | 2/2014 | Yu | H01R 13/7031 439/188 |
| 2014/0051303 | A1 * | 2/2014 | Yu | H01R 13/46 439/660 |
| 2014/0315405 | A1 * | 10/2014 | Yu | H01R 13/7032 439/188 |

* cited by examiner

*Primary Examiner* — Tulsidas C Patel
*Assistant Examiner* — Peter G Leigh

(57) ABSTRACT

The present invention is a detecting structure of receptacle connector, which comprises a receptacle connector having an insulating base, multiple signal terminals and a shielding housing; at least two contact elastic clips provided respectively on both sides of the shielding housing; and at least two detecting terminals provided respectively on both sides of the insulating base, and each of the detecting terminals contacts with each of the contact elastic clips movably. Thereby, a plug connector and the receptacle connector may butt mutually for appropriate displacement between each of the contact elastic clips and each of the detecting terminals in order to perform the detection by truncating contact signals or generating contact signals to achieve the effects of simple structure, easy operation and effective detection.

2 Claims, 15 Drawing Sheets

DETECTING STRUCTURE OF RECEPTACLE CONNECTOR

BACKGROUND OF THE INVENTION

1. Field of the Invention

The present invention is a detecting structure of receptacle connector, particularly relates to a detecting structure for USB connector.

2. Descriptions of the Prior Art

It is known that a general conventional USB connector is provided with detecting terminals to detect inserted USB plug connector for activating signal transmission, turning on power supply or achieving other detection functions.

However, the methods of conventional related patents to join detecting terminal and connector insulation body are relatively complex and tend to result in shortages, such as uneasy assembly and poor electrical characteristics after assembly. These conventional related patents include Taiwan patents, such as, No. M335059 "Electrical Connector", No. M441957 "Electrical Connector", No. M450098 "Electrical Connector", No. M338462 "Electrical Connector with Switch Function", No. I403028 "High Frequency Socket Connector with Plug Detection Function", No. M430040 "Electrical Connector Socket", No. M431481 "Electrical Connector with Detection Function", No. M443300 "Electrical Connector Structure", No. M450876 "Connector Socket" and public No. 201312880 "SPECIAL USB PLUG HAVING DIFFERENT STRUCTURE FROM STANDARD USB PLUG AND USB RECEPTACLE MATABLE WITH THE SPECIAL USB PLUG".

In view of the fact, the inventor of the invention has made efforts to study and develop a detecting structure of receptacle connector in order to overcome various shortages of the conventional technologies mentioned above.

SUMMARY OF THE INVENTION

The main objective of the present invention is in that a plug connector and a receptacle connector may butt mutually for appropriate displacement occurs between each contact elastic clip and each detecting terminal. In turn, detection is performed by truncating contact signals or generating contact signals to achieve effects of simple structure, easy operation and effective detection.

To achieve above objectives, the present invention is a detecting structure of receptacle connector, which includes: a receptacle connector having a insulating base, multiple signal terminals and a shielding housing; at least two contact elastic clips provided respectively on two sides of the shielding housing; and at least two detecting terminals provided on both sides of the insulating body, and each detecting terminal contacts with each contact elastic clip movably.

In the preferred embodiment, the insulating base of the receptacle connector comprises a seat, a tongue perpendicular to one surface of the seat, and two mating troughs provided respectively on two sides of the seat, while one end of each signal terminal is provided on the tongue, and the other end is extended and provided on a seat, and each said detecting terminal is provided respectively in each mating trough.

In the preferred embodiment, the shielding housing comprises a first shell covering the tongue, and a second shell covering the seat, while each of the said contact elastic clips is provided respectively on both sides of one end surface of the first shell.

In the preferred embodiment, two side edges of the first shell are provided respectively with one fixing plate extended upward, and each surface of the first shell is provided respectively with a abutting portion thereon, while each contact elastic clip is provided respectively on both sides of the top surface of the first shell, and furthermore, both sides of the second shell have respectively one engaging plate joining with the fixing plate.

In the preferred embodiment, each contact elastic clip comprises an extending portion connecting with the first shell, a curved face connected with the extending portion, and an abutting portion connected with the curved face and contacted with one end of the detecting terminal.

In the preferred embodiment, each detecting terminal comprises respectively a welding portion protruded out from the seat, a connecting portion connected with the welding portion, an intervening portion connected with the connecting portion and engaged in the mating trough, and a bending portion connected with the intervening portion and contacted with the abutting portion, furthermore, each mating trough is provided on both sides of top surface of the seat respectively.

In the preferred embodiment, the two side edges of the first shell are provided respectively with a fixing plate extended downward, and each surface of the first shell is provided with a abutting portion thereon, while each contact elastic clip is provided respectively on both sides of a bottom end surface of the first shell, and furthermore, the two sides and one end of the second shell have an engaging plate joining the fixing plate respectively.

In the preferred embodiment, each contact elastic clip comprises an extending portion connected with the first shell, a curved face connected with the extending portion, and an abutting portion connected with the curved face and corresponding to one end of the detecting terminal.

In the preferred embodiment, each detecting terminal comprises respectively a welding portion protruded out from the seat, a bending portion connected with the welding portion, and a slab connected with the bending portion and corresponding to the abutting portion, and furthermore, each mating trough is provided respectively on both sides of a bottom surface of the seat.

DETAILED DESCRIPTION OF THE PREFERRED EMBODIMENT

The invention is explained in detail in conjunction with attached drawings below by the following detailed description of preferred embodiments in order for full understanding of the intensions, features and effects of the invention.

Figure 1:
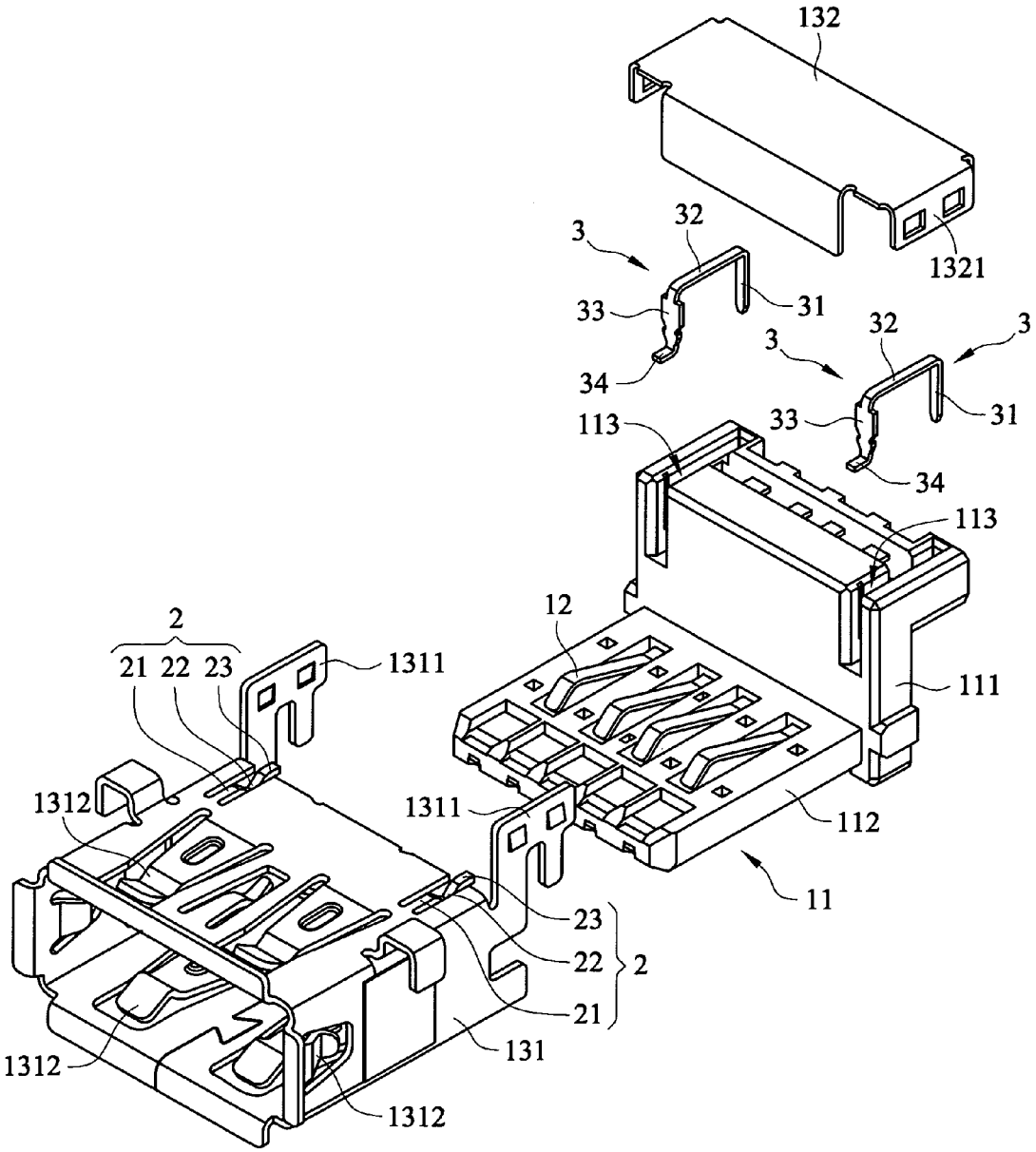
FIG. 1 is a stereo exploded schematic showing a first embodiment of the present invention.
Figure 2:
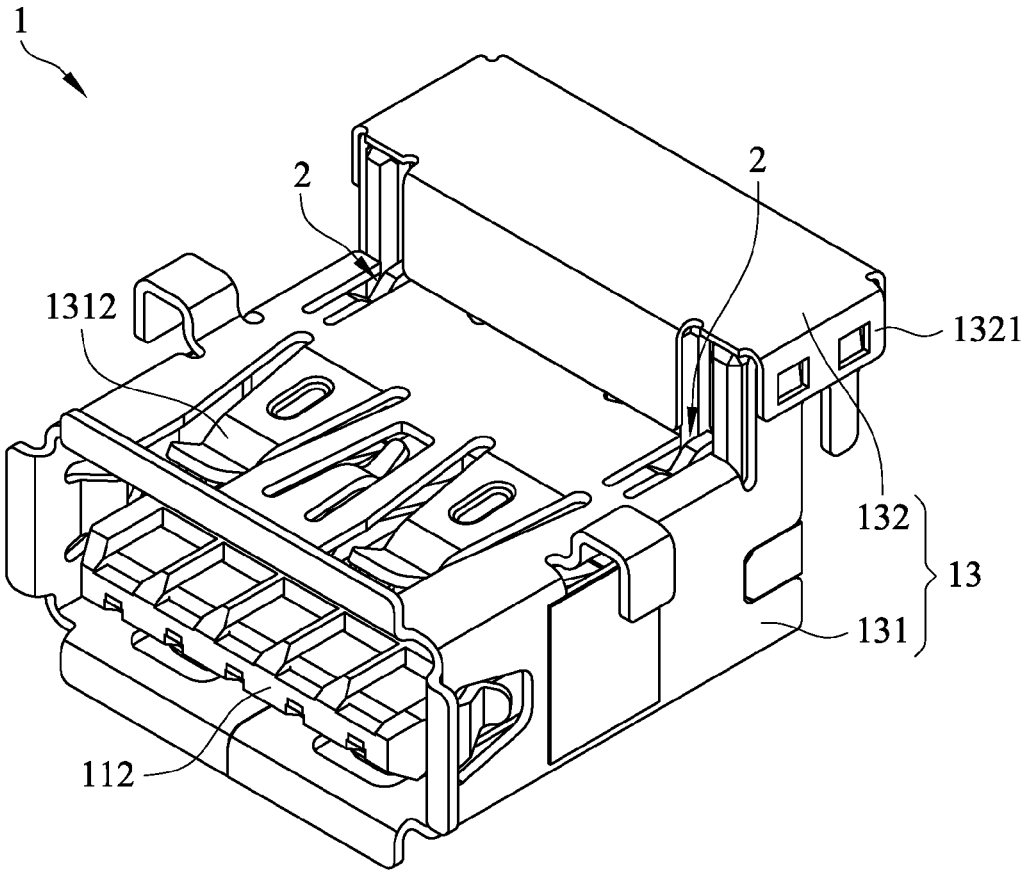
FIG. 2 is a stereo appearance schematic showing the first embodiment of the present invention.
Figure 3:
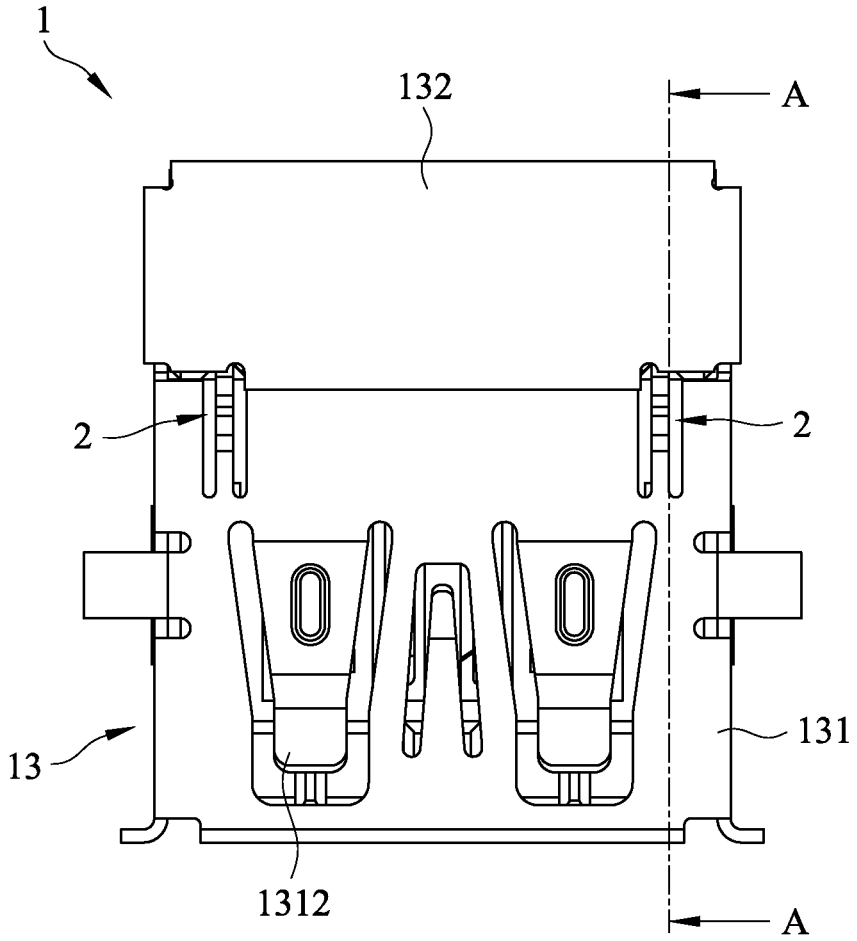
FIG. 3 is a schematic top view showing the first embodiment of the present invention.
Figure 4:
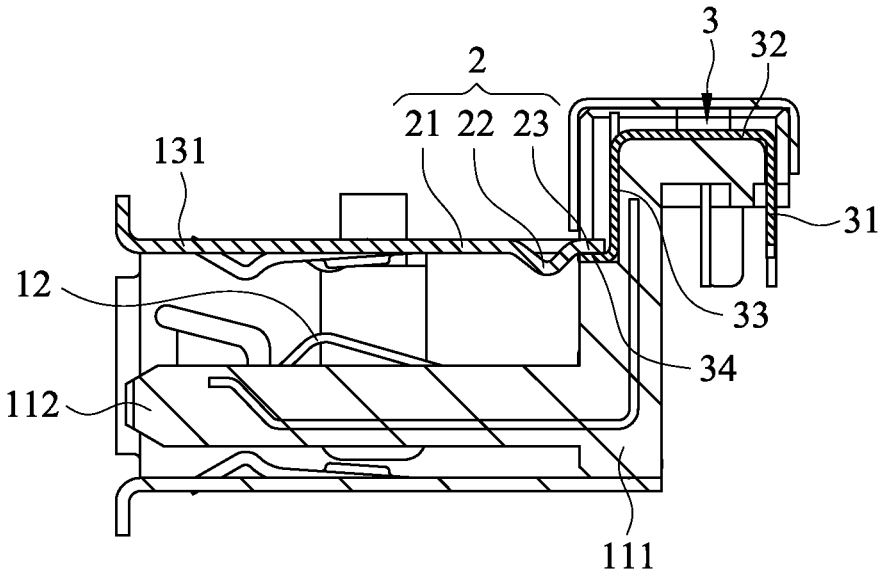
FIG. 4 is a schematic showing A-A cross section of FIG. 3 of the present invention.

Refer to FIGS. 1, 2, 3 and 4, which are a stereo exploded schematic showing a first embodiment of the present invention, a stereo appearance schematic showing the first embodiment of the present invention, a schematic top view showing the first embodiment of the present invention, and a schematic showing A-A cross section of FIG. 3 of the present invention, respectively. As shown in the Figures, the present invention is a detecting structure of receptacle connector composed of at least one receptacle connector 1, at least two contact elastic clips 2 and at least two detecting terminals 3.

The said receptacle connector 1 is an USB connector, which includes an insulating base 11, a plurality of signal terminals 12 provided on the insulating base 11, and a shielding housing 13 covering exterior of the insulating base 11, wherein the insulating base 11 comprises a seat 111, a tongue 112 provided perpendicular to one surface of the seat 111, and two mating troughs 113 provided on both sides of the seat 111 respectively, while one end of each signal terminal 12 is provided on the tongue 112, and the other end is extended and provided on a base 111; and the shielding housing 13 comprises a first shell 131 covering a tongue 112, and a second shell 132 covering a seat 111, wherein two side edges of the first shell 131 have a fixing plate 1311 extended upward respectively, and each surface of the first shell 131 is provided with a abutting portion 1312, and furthermore, both sides of the second shell 132 have a engaging plate 1321 joining with the fixing plate 1311 respectively.

Each contact elastic clip 2 is provided respectively on both sides of top surface of the first shell 131 provided by the shielding housing 13, while each contact elastic clip 2 comprises an extending portion 21 connected with the first shell 131, a curved face 22 connected with the extending portion 21, and an abutting portion 23 connected with the curved face 22 and contacted with one end of the detecting terminal 3.

Each detecting terminal 3 is provided respectively in each mating trough 113 of the two sides of the top surface of the seat 111 provided by the insulating base 11, and each detecting terminal 3 is contacted with each contact elastic clip 2 movably, respectively, while each detecting terminal 3 comprises a welding portion 31 protruded out from the seat 111, a connecting portion 32 connected with the welding portion 31, an intervening portion 33 connected with the connecting portion 32 and engaged in the mating trough 113, and a bending portion 34 connected with the intervening portion 33 which is contacted with the abutting portion 23.

Figure 5:
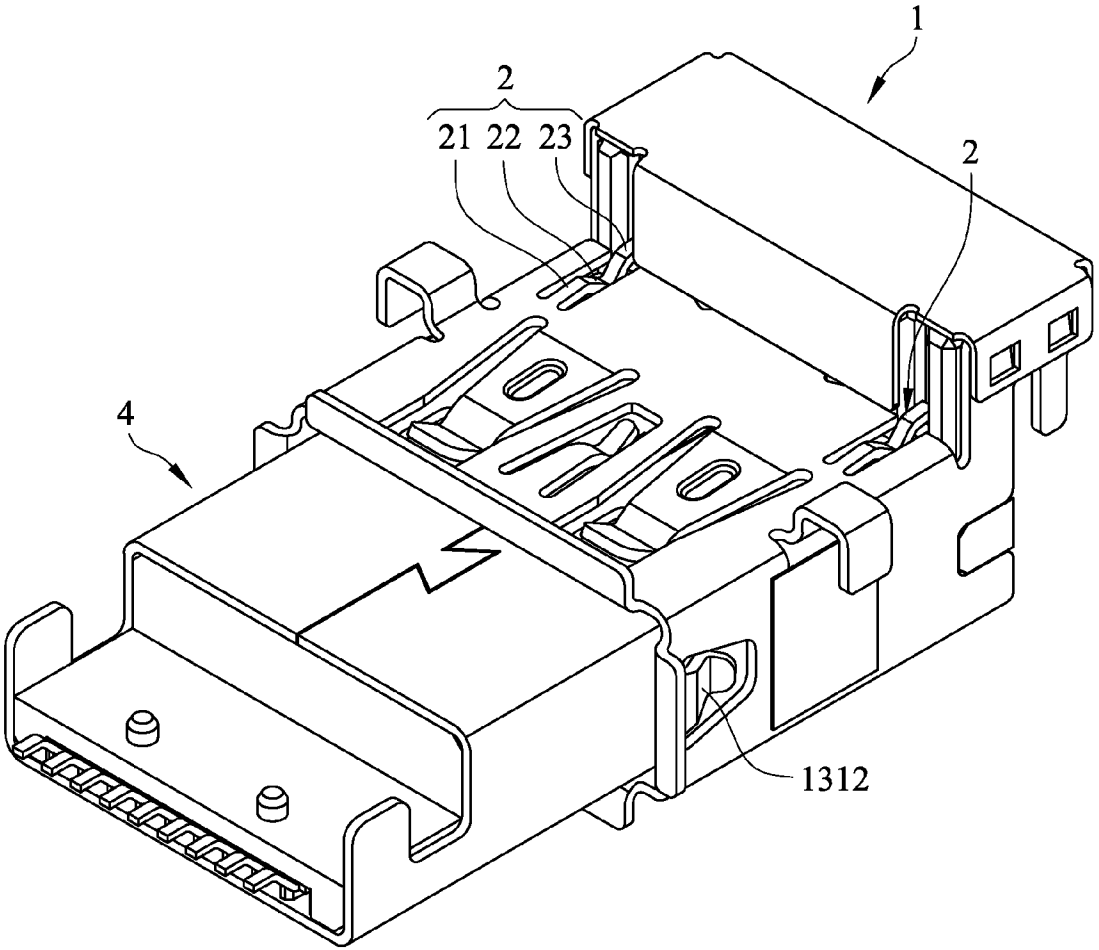
FIG. 5 is a schematic showing the first embodiment of the present invention in an operating state.
Figure 6:
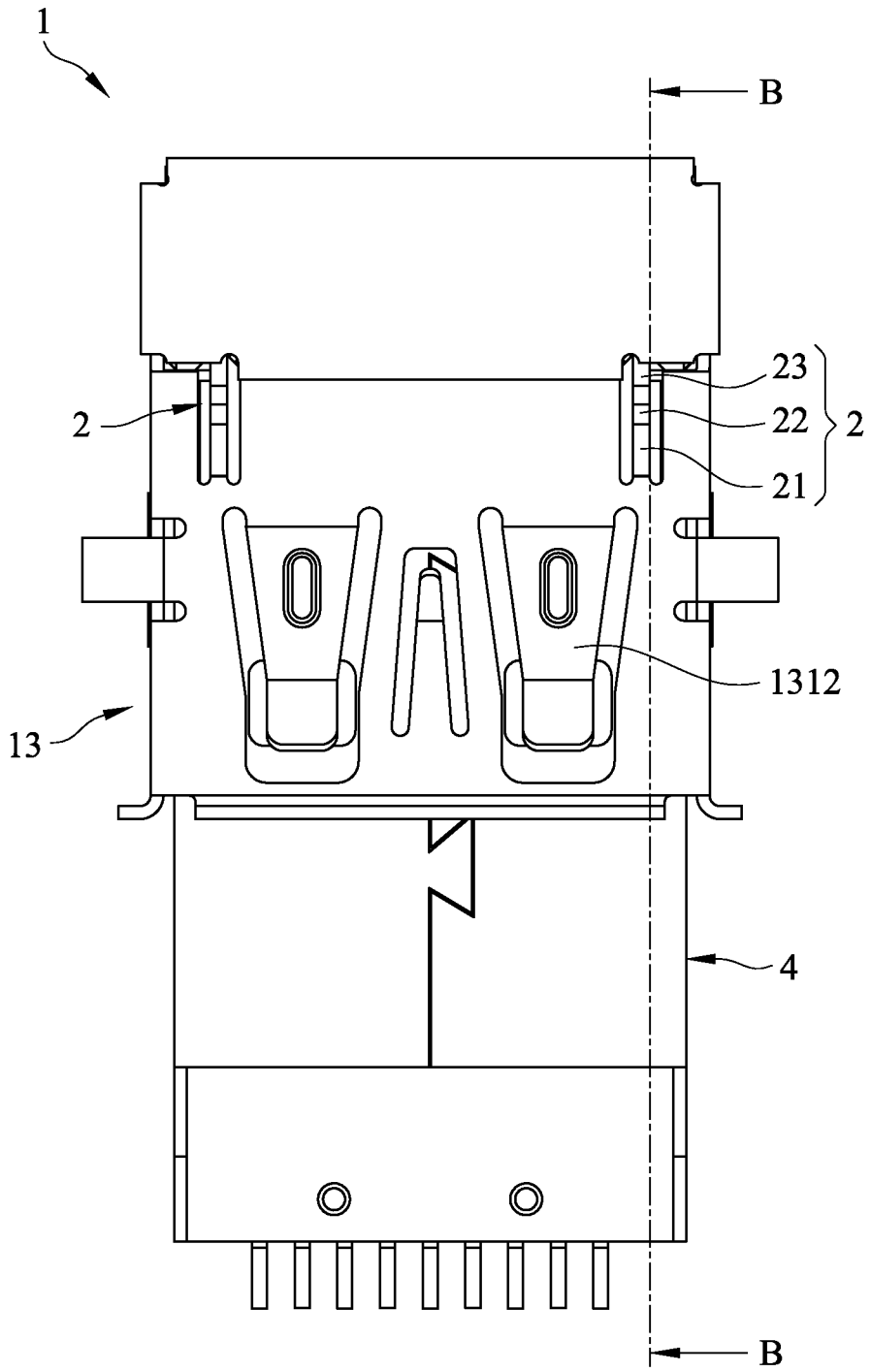
FIG. 6 is a top view showing the first embodiment of the present invention in the operating state.
Figure 7:
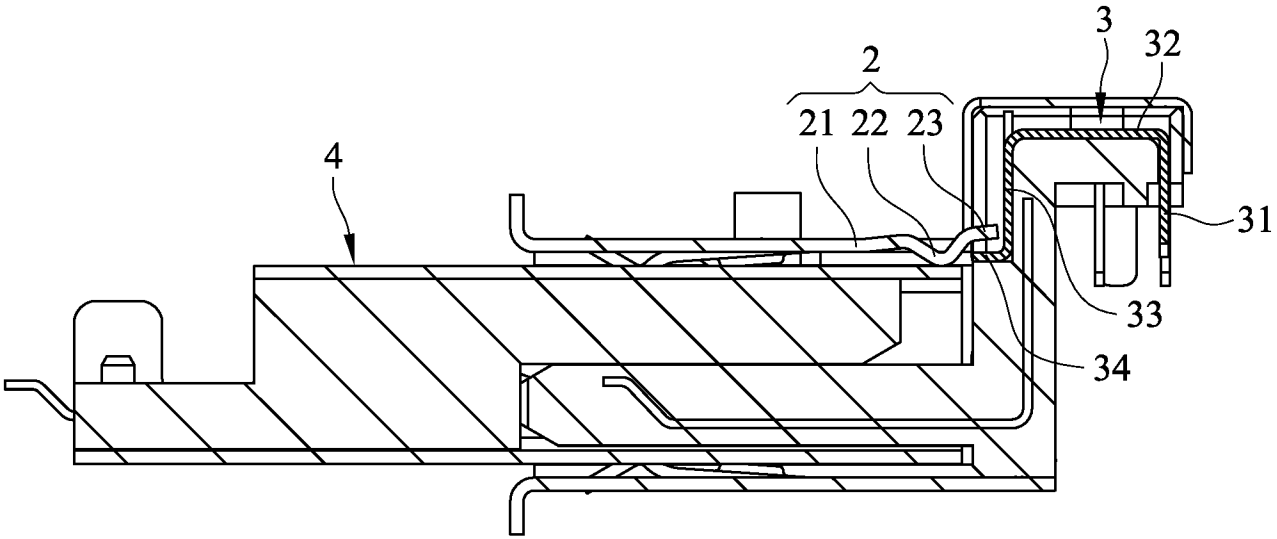
FIG. 7 is a schematic showing B-B cross section of FIG. 6 of the present invention.
Figure 8:
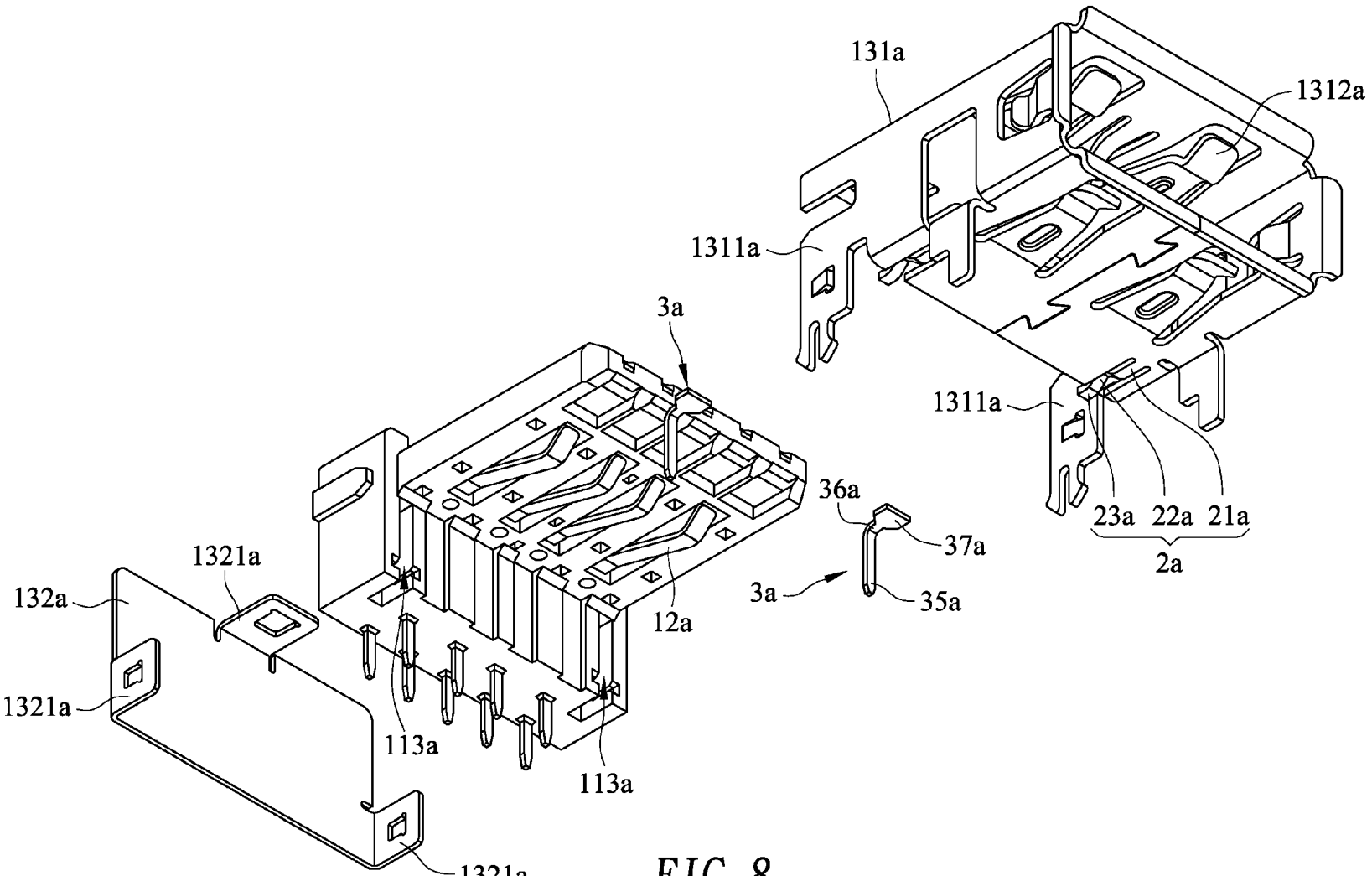
FIG. 8 is a stereo exploded schematic showing a second embodiment of the present invention.
Figure 9:
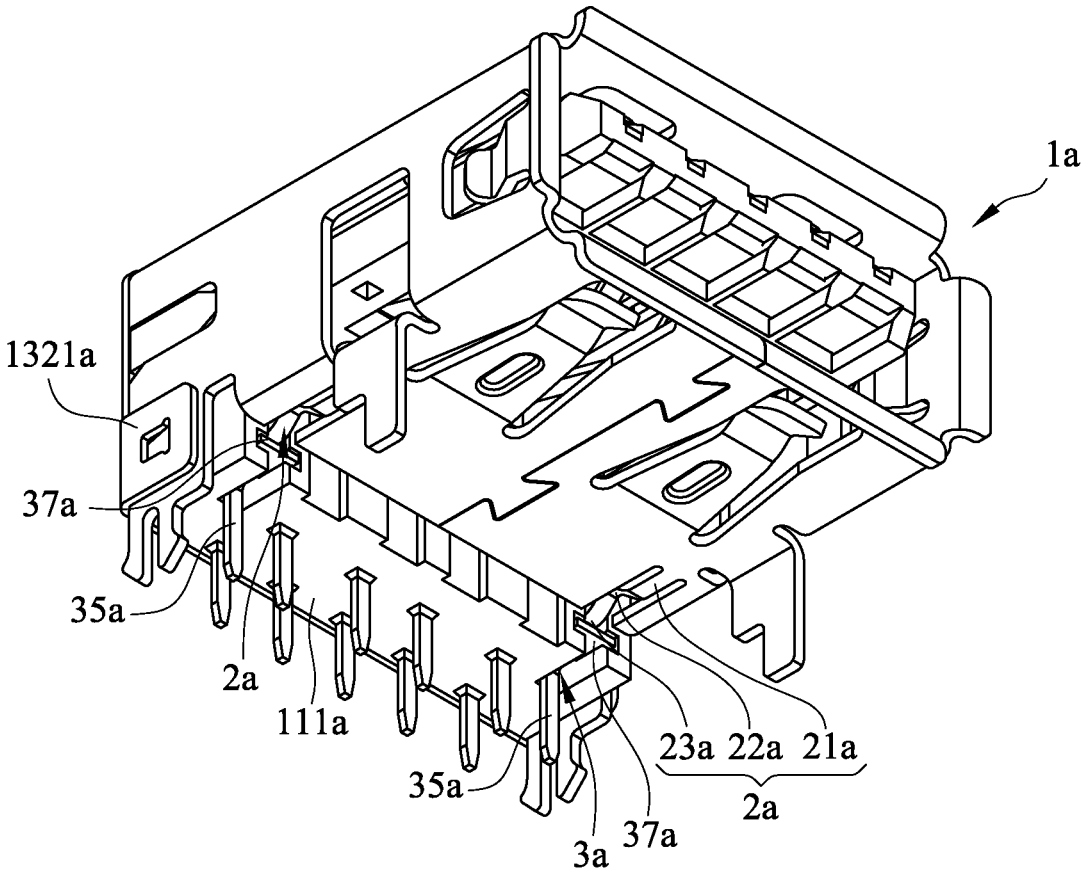
FIG. 9 is a stereo appearance schematic showing the second embodiment of the present invention.
Figure 10:
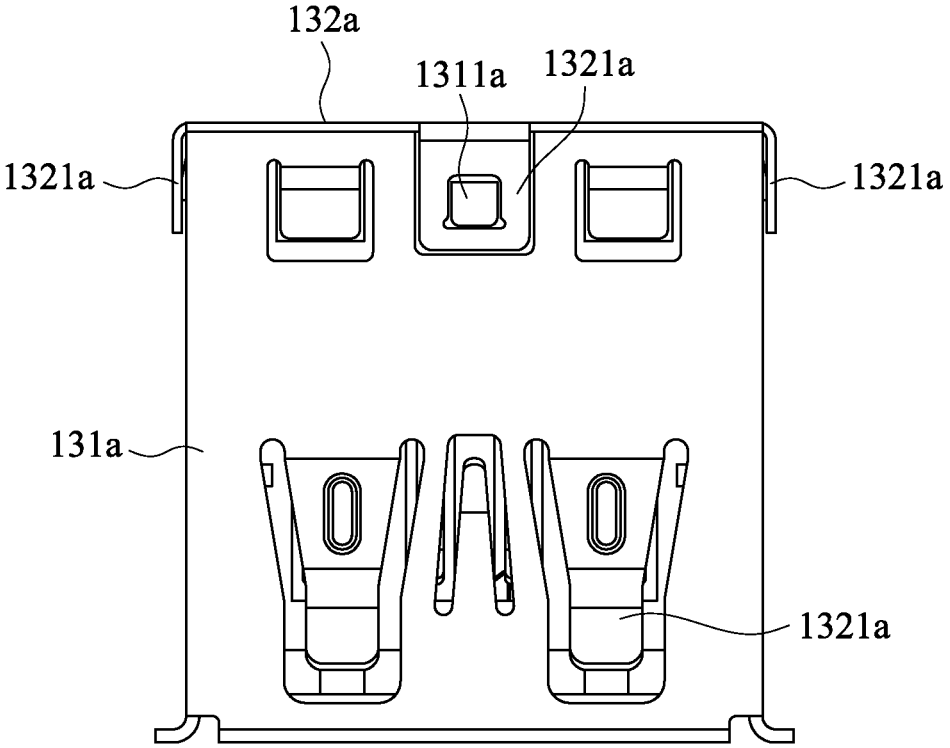
FIG. 10 is a schematic top view showing the second embodiment of the present invention.

Refer to FIGS. 5, 6 and 7, which are a schematic showing the first embodiment of the present invention in an operating state, a top view showing the first embodiment of the present invention in the operating state, and a schematic showing B-B cross section of FIG. 6 of the present invention, respectively. As shown in the Figures, as the present invention is employed, a soldering end of each signal terminal 12 and a welding portion 31 of each detecting terminal 3 may be welded on a main board (not shown). As it is used (refer also to FIGS. 1 to 4), it may be used for related plug connector 4 to butt. Moreover, after the plug connector 4 and the receptacle connector 1 of the present invention butt together, the first shell 131 contains the plug connector 4 for each abutting portion 1312 of the first shell 131 to abut respectively against periphery on each side of the plug connector 4, and for each terminal (not shown) of the plug connector 4 to be conducted with each signal terminal 12. Further, after the said butting operation is completed, a top surface of the plug connector 4 will push the curved face 22 of each contact elastic clip 2 for the curved face 22 to be displaced upward in adaptation to the extending portion 21, since the abutting portion 23 was contacted with the bending portion 34 provided by each detecting terminal 3 to be detached then, therefore the abutting portion 23 of each contact elastic clip 2 is not contacted with the bending portion 34 of each detection terminal 3 any more. At the moment, each detecting terminal 3 will generate a truncation signal (which indicates that the plug connector 4 and the receptacle connector 1 have butted mutually already) for the main board to receive a detect signal sent from each detecting terminal 3. Thereby, the subsequent operations are performed to achieve the effects of simple structure, easy operation and effective detection.

Figure 11:
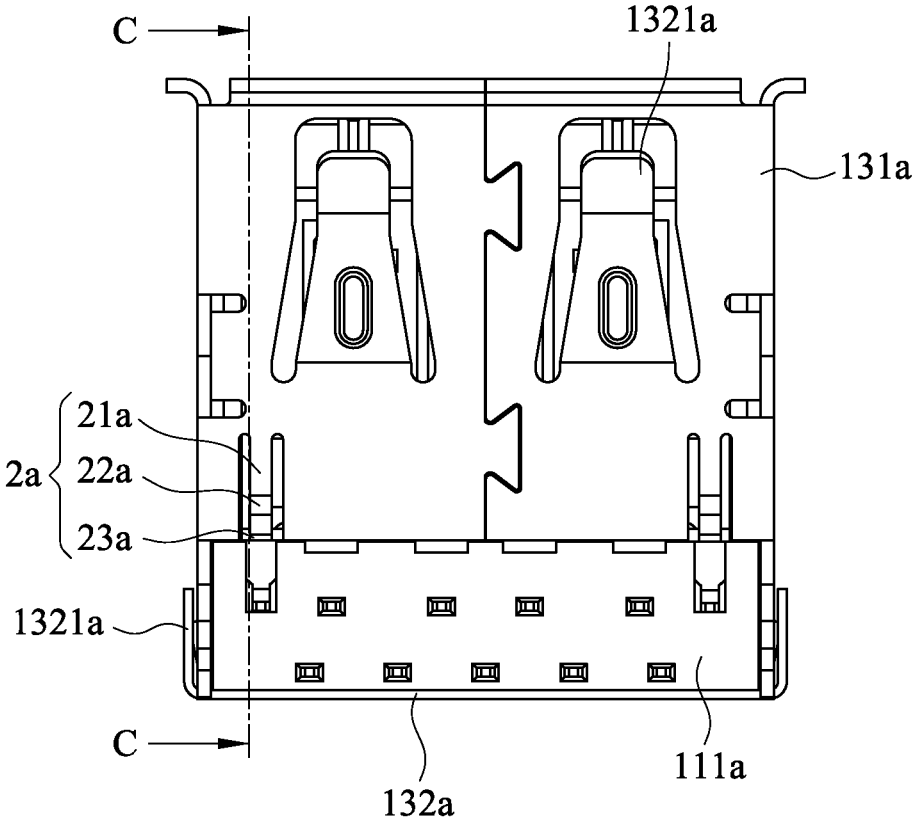
FIG. 11 is a schematic bottom view showing the second embodiment of the present invention.
Figure 12:
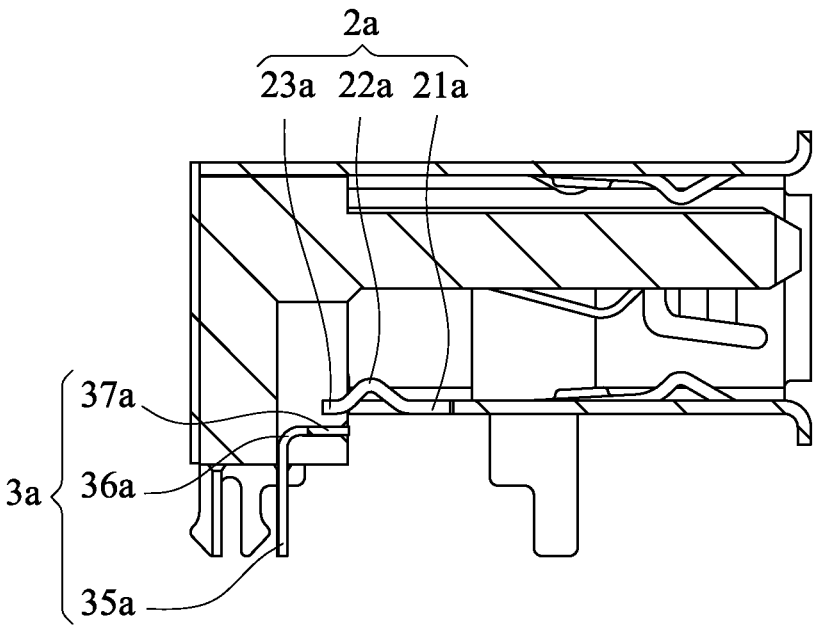
FIG. 12 is a schematic showing C-C cross section of FIG. 11 of the present invention.

Refer to FIGS. 8, 9, 10, 11 and 12, which are a stereo exploded schematic showing a second embodiment of the present invention, a stereo appearance schematic showing the second embodiment of the present invention, a schematic top view showing the second embodiment of the present invention, a schematic bottom view showing the second embodiment of the present invention, and a schematic showing C-C cross section of FIG. 11 of the present invention, respectively. As shown in the Figures, besides the structure form proposed in the first embodiment above, the present invention may be a structure form proposed in the second embodiment except that the shielding housing 13*a* provided by the receptacle connector 1*a* is provided respectively with a fixing plate 1311*a* extended downward on the two side edges and top surface of the first shell 131*a*, and each surface of the first shell 131*a* is provided respectively with a abutting portion 1312*a*, while each contact elastic clip 2*a* is provided on both sides of a bottom end surface of the first shell 131*a* respectively. Also, the two sides and one end of the second shell 132*a* have an engaging plate 1321*a* joining with the fixing plate 131*a* respectively, and each mating trough 113*a* is provided on both sides of a bottom surface of the seat 111*a*. Each contact elastic clip 2*a* comprises an extending portion 21*a* connected with the first shell 13*a*, a curved face 22*a* connected with the extending portion 21*a*, and an abutting portion 23*a* connected with the curved face 22*a* which is corresponding to one end of the detection terminal 3*a*. Each detecting terminal 3*a* is provided respectively in each mating trough 113*a* on the two sides of the bottom surface of the seat 111*a*. Moreover, each detecting terminal 3*a* comprises a welding portion 35*a* protruded out from the seat 111*a* respectively, a bending portion 36*a* connected with the welding portion 35*a*, and a slab 37*a* connected with the bending portion 36*a* and corresponding to the abutting portion 23*a* without contact.

Figure 13:
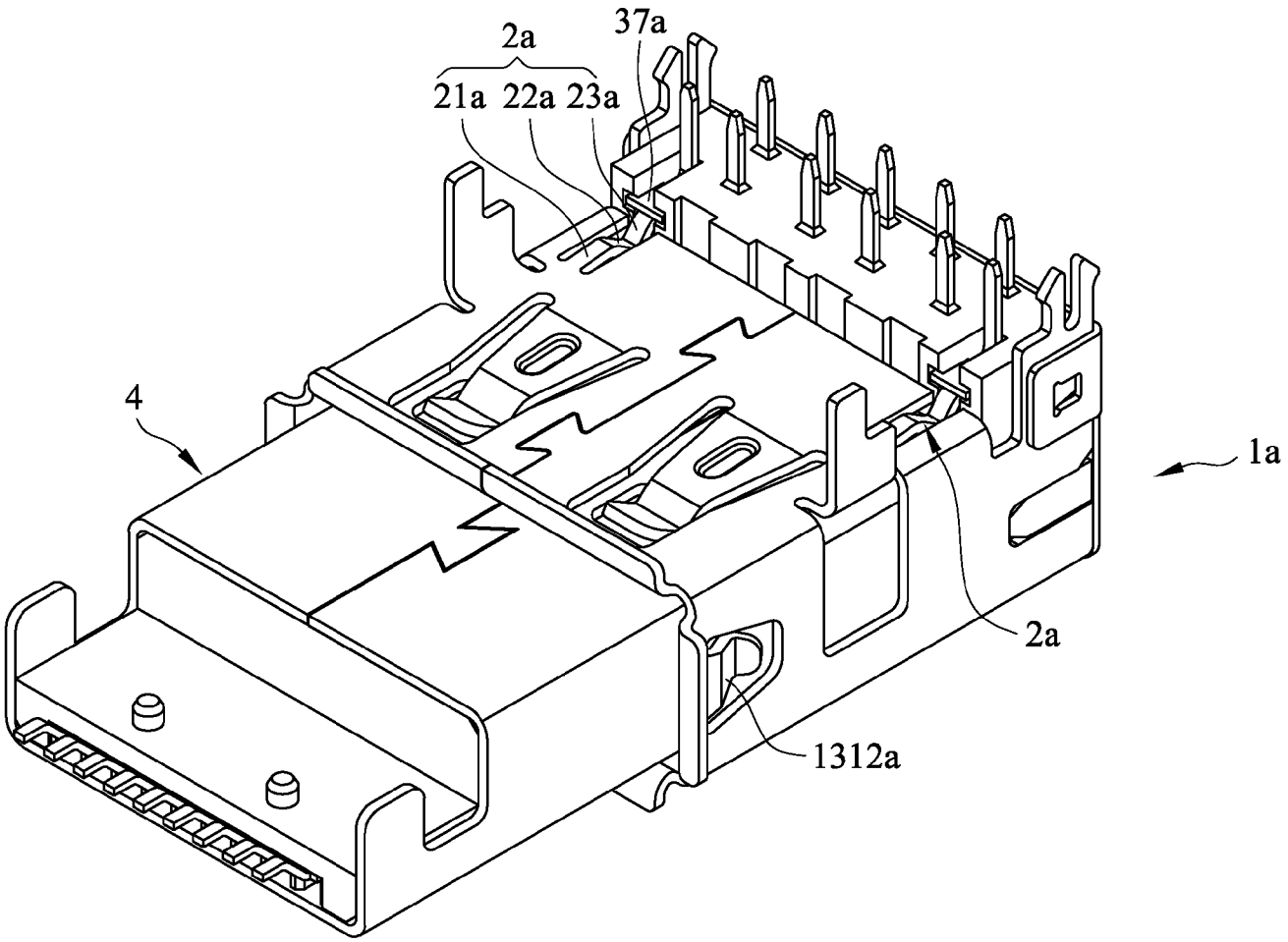
FIG. 13 is a schematic showing the second embodiment of the present invention in an operating state.
Figure 14:
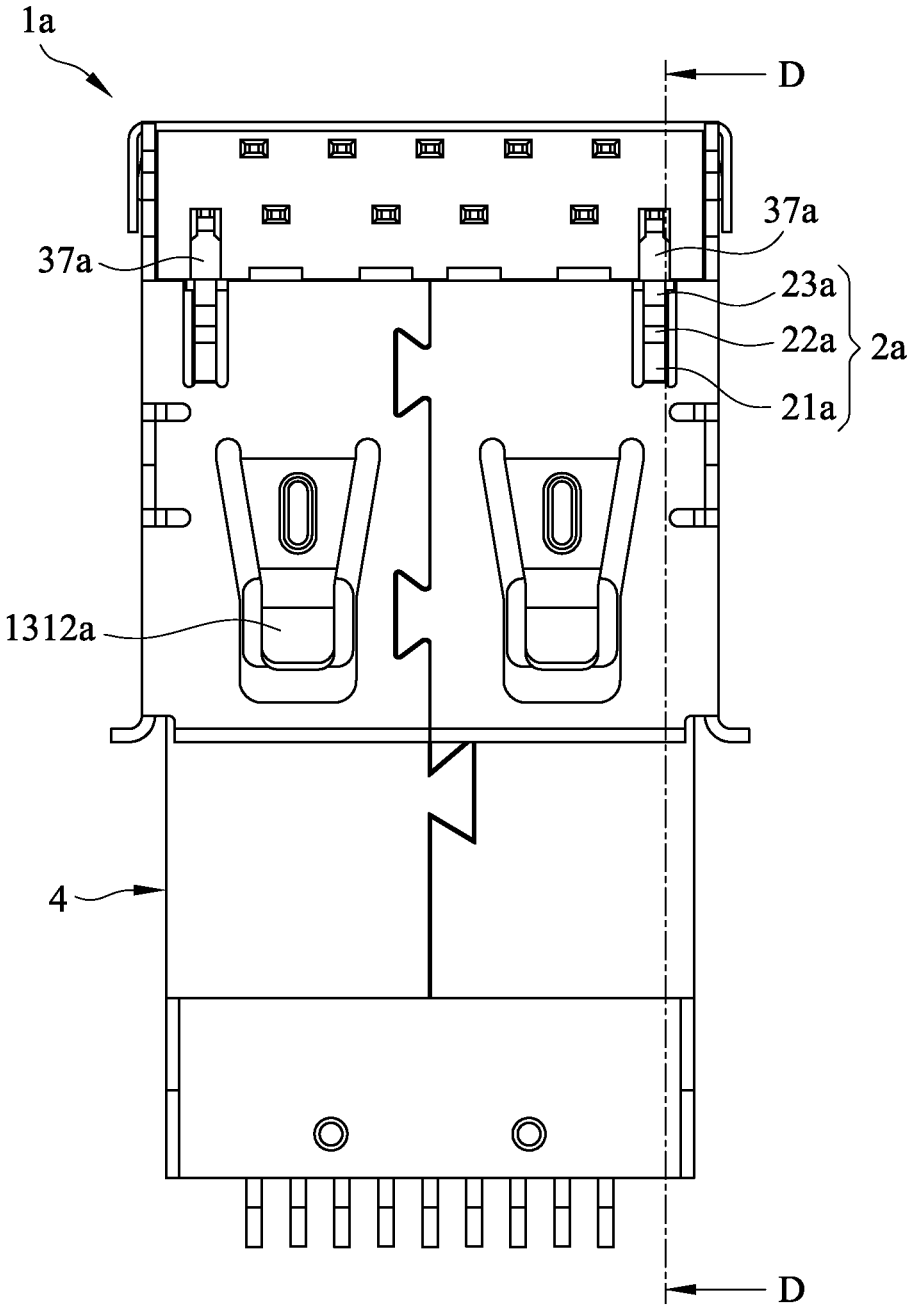
FIG. 14 is a top view showing the second embodiment of the present invention in the operating state.
Figure 15:
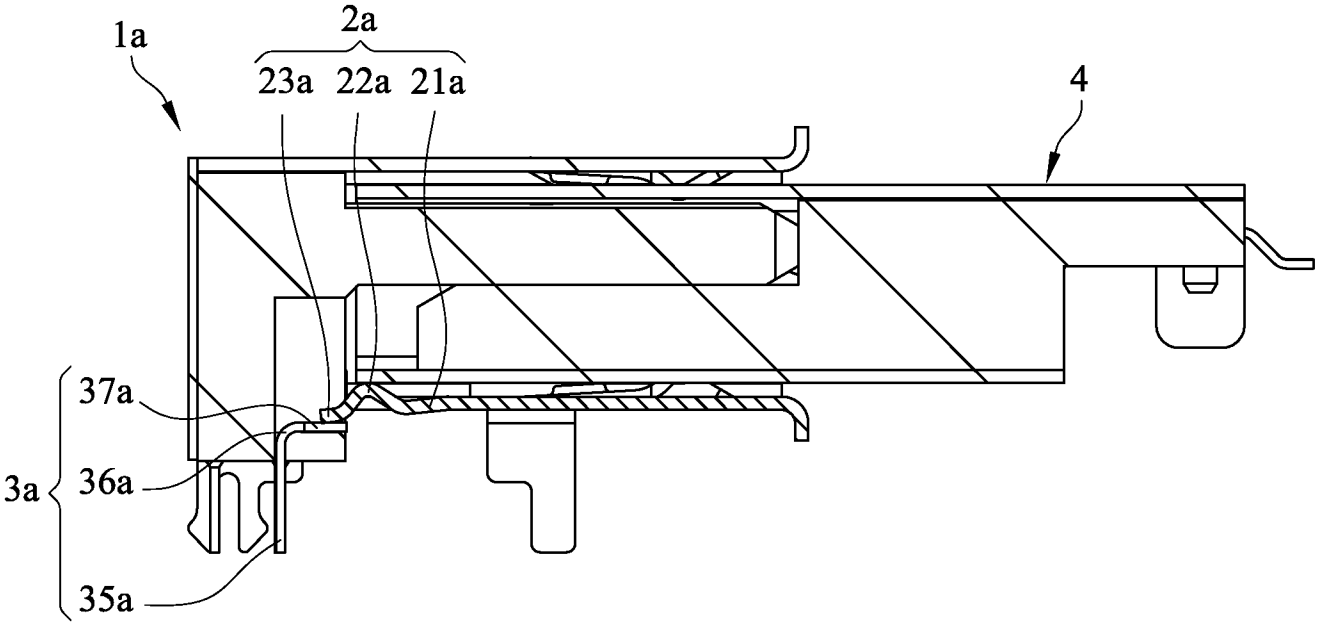
FIG. 15 is a schematic showing D-D cross section of FIG. 14 of the present invention.

Refer to FIGS. 13, 14 and 15, which are a schematic showing the second embodiment of the present invention in an operation state, a top view showing the second embodiment of the present invention in the operation state, and a schematic showing D-D cross section of FIG. 14 of the present invention, respectively. As shown in the Figures, as the present invention is employed, a soldering end of each signal terminal 12*a* and a welding portion 35*a* of each detecting terminal 3*a* may be welded on a main board (not shown). Moreover, in using, (also refer to FIGS. 8 to 12 in conjunction), it may be provided to butt with a related plug connector 4. Further, after the plug connector 4 is butted with a receptacle connector 1*a* of the present invention together, the plug connector 4 is contained by a first shell 131*a* for each abutting portion 1312*a* of the first shell 131*a* to abut respectively against periphery on each side of the plug connector 4, and for each terminal (not shown) of the plug connector 4 to be conducted with each signal terminal 12*a*. Moreover, after the above butting operation is completed, a top surface of the plug connector 4 will push a curved face 22*a* of each contact elastic clip 2*a* for the curved face 22*a* to be displaced downward in adaptation to an extending portion 21*a*, such that an abutting portion 23*a* corresponding to a slab 37*a* provided by each detecting terminal 3*a* which is in a contact state for the abutting portion 23*a* of each contact elastic clip 2*a* to be contacted and conducted with the slab 37*a* of each detecting terminal 3*a*. At the moment, each detecting terminal 3*a* will generate a contact signal (indicating of mutual butting of the plug connector 4 and the receptacle connector 1*a*) for the main board to receive a detect signal sent from each detecting terminal 3*a*. Thereby, the subsequent operation is performed to achieve the effects of simple structure, easy operation and effective detection.

In conclusion, according to the above disclosed contents, the invention does achieve expected objectives of the recreation. A plug connector and a receptacle connector may be butted mutually by a detecting structure of receptacle connector. After that, appropriate displacement may occur between each contact elastic clip and each detecting terminal to perform detection by truncating a contact signal or generating a contact signal. Consequently, the effects of simple structure, easy operation and effective detection are accomplished.

What is claimed is:

1. A detecting structure of receptacle connector, including a receptacle connector comprising an insulating base, a plurality of signal terminals provided on the insulating base, and a shielding housing covering the exterior of the insulating base, wherein the insulating base of the receptacle connector comprises a seat, a tongue perpendicular to one surface of the seat, and two mating troughs provided on the two sides of the seat, respectively, furthermore, one end of each of the signal terminals is provided on the tongue while the other end thereof is extended and provided on a seat, the shielding housing comprises a first shell covering a tongue, and a second shell covering a seat;

two contact elastic clips are provided on two sides of one end surface of the first shell, respectively; and two detecting terminals provided on both sides of the insulating base respectively, each of the detecting terminals being contacted with each of the contact elastic clips movably, respectively, wherein each of the detecting terminals is provided in each of the mating troughs, and each of the detecting terminals comprises respectively a welding portion protruded out from a seat, a connecting portion connected with the welding portions, an intervening portion connected with the connecting portion and engaged in a mating trough, and a bending portion connected with the intervening portion which is contacted with the abutting portion, and furthermore, each of the mating troughs is provided on both sides of a top surface of a seat, respectively; which is characterized:

two side edges of the first shell are provided with one fixing plate extended upward, respectively, and each surface of the first shell is provided with one respective abutting portion, while the contact elastic clips are provided on the two sides of a top surface of the first shell, respectively, and both sides of the second shell are provided with an engaging plate joined with the fixing plate, respectively;

each of the contact elastic clips comprises an extending portion connected with the first shell, a curved face connected with the extending portion, and an abutting portion connected with the curved face and contacted with one end of the detecting terminal.

2. A detecting structure of receptacle connector, including a receptacle connector comprising an insulating base, a plurality of signal terminals provided on the insulating base, and a shielding housing covering the exterior of the insulating base, wherein the insulating base of the receptacle connector comprises a seat, a tongue perpendicular to one surface of the seat, and two mating troughs provided on the two sides of the seat, respectively, furthermore, one end of each of the signal terminals is provided on the tongue while the other end thereof is extended and provided on a seat, the shielding housing comprises a first shell covering a tongue, and a second shell covering a seat;

two contact elastic clips are provided on two sides of one end surface of the first shell, respectively; and two detecting terminals provided on both sides of the insulating base respectively, each of the detecting terminals being contacted with each of the contact elastic clips movably, respectively, and each of the detecting terminals is provided in each of the mating troughs; which is characterized;

the two side edges of the first shell are provided respectively with a fixing plate extended downward, and each surface of the first shell is provided with a abutting portion thereon respectively, while the contact elastic clips are provided on both sides of a bottom end surface of the first shell respectively, and furthermore, two sides and one end of the second shell have engaging plates joining with the fixing plate respectively;

each of the contact elastic clips comprises an extending portion connected with the first shell, a curved face connected with the extending portion, and an abutting portion connected with the curved face which is corresponding to one end of the detecting terminal;

each of the detecting terminals comprises a welding portion protruding out from the seat respectively, a bending portion connected with the welding portion, and a slab connected with the bending portion and corresponding to the abutting portion, and furthermore, two mating troughs are provided on both sides of a bottom surface of the seat, respectively.

* * * * *